US009953602B2

(12) United States Patent
Choi et al.

(10) Patent No.: US 9,953,602 B2
(45) Date of Patent: Apr. 24, 2018

(54) METHOD OF DRIVING DISPLAY PANEL, DISPLAY PANEL DRIVING APPARATUS FOR PERFORMING THE METHOD AND DISPLAY APPARATUS HAVING THE DISPLAY PANEL DRIVING APPARATUS

(71) Applicant: SAMSUNG DISPLAY CO., LTD., Yongin (KR)

(72) Inventors: Young-Woo Choi, Suwon-si (KR); Jung-Taek Kim, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 38 days.

(21) Appl. No.: 14/660,075

(22) Filed: Mar. 17, 2015

(65) Prior Publication Data

US 2016/0111057 A1 Apr. 21, 2016

(30) Foreign Application Priority Data

Oct. 15, 2014 (KR) ..... 10-2014-0139112

(51) Int. Cl.
*G09G 3/36* (2006.01)

(52) U.S. Cl.
CPC ... *G09G 3/3666* (2013.01); *G09G 2300/0426* (2013.01); *G09G 2310/0281* (2013.01)

(58) Field of Classification Search
CPC .. G09G 3/3685; G09G 3/003; G09G 2320/02; G09G 2320/10; G09G 3/3666; G09G 2310/0281; G09G 2300/0426; G09G 2320/0686; G09G 3/342; G09G 3/3426
USPC ..... 345/48–53, 38–39, 84–97, 690–691
See application file for complete search history.

(56) References Cited

U.S. PATENT DOCUMENTS 5,412,395 A * 5/1995 Maeda ..... G09G 3/2051 345/694
5,751,265 A * 5/1998 Han ..... G09G 3/3607 345/691
6,542,141 B1 * 4/2003 Mano ..... G09G 3/2018 345/691
7,889,165 B2 * 2/2011 Hwang ..... G02F 1/136259 345/214
7,928,948 B2 * 4/2011 Hagino ..... G09G 3/3614 345/79
7,965,274 B2 * 6/2011 Okada ..... G02F 1/167 345/107

(Continued)

FOREIGN PATENT DOCUMENTS

KR 10-2006-0077364 A 7/2006
KR 10-2006-0078675 A 7/2006

(Continued)

*Primary Examiner* — Vinh Lam
(74) *Attorney, Agent, or Firm* — Lee & Morse, P.C.

(57) ABSTRACT

A method for driving a display panel includes at least two driving operations. The first driving operation includes driving a first display area of the display panel by outputting a data signal of a first frame to the first display area and driving a gate line of a first gate line group in the first display area. The second driving operation includes driving a second display area of the display panel by outputting a data signal of a second frame to the second display area and driving a gate line of a second gate line group in the second display area. The first display area is adjacent to the second display area, and the first frame is different from the second frame.

20 Claims, 11 Drawing Sheets

(56) References Cited

U.S. PATENT DOCUMENTS 8,842,107 B2 * 9/2014 Kim ..... G02B 27/2214 345/204
8,896,584 B2 * 11/2014 Liu ..... G09G 3/3648 345/209
2001/0030636 A1 * 10/2001 Ito ..... G09G 3/3622 345/87
2002/0057241 A1 * 5/2002 Oda ..... G09G 3/2011 345/87
2003/0080932 A1 * 5/2003 Konno ..... G09G 3/3648 345/96
2003/0085861 A1 * 5/2003 Hoshino ..... G09G 3/3622 345/89
2003/0137478 A1 * 7/2003 Naganuma ..... G09G 3/2062 345/89
2006/0044241 A1 * 3/2006 Yuh-Ren ..... G09G 3/3648 345/89
2007/0195028 A1 * 8/2007 Katayama ..... G09G 3/2011 345/87
2008/0055219 A1 * 3/2008 Jung ..... G09G 3/2022 345/89
2008/0079675 A1 * 4/2008 Yang ..... G09G 3/3648 345/87
2008/0158128 A1 * 7/2008 Feng ..... G09G 3/3614 345/96
2008/0170025 A1 * 7/2008 Song ..... G09G 3/3614 345/96
2008/0186267 A1 * 8/2008 Mamba ..... G09G 3/3655 345/87
2009/0219241 A1 * 9/2009 Tamura ..... G09G 3/3614 345/89
2009/0231314 A1 * 9/2009 Hanaoka ..... G09G 3/2096 345/208
2011/0141003 A1 * 6/2011 Kim ..... G09G 3/342 345/102
2011/0157257 A1 * 6/2011 Bennett ..... G06F 3/14 345/690
2012/0026214 A1 * 2/2012 Oke ..... G09G 3/342 345/690
2013/0016076 A1 * 1/2013 Liu ..... G09G 3/3648 345/204
2014/0340297 A1 * 11/2014 Oke ..... G09G 3/3666 345/103
2015/0054720 A1 * 2/2015 Takeda ..... G09G 3/3233 345/76
2016/0019856 A1 * 1/2016 Tanaka ..... G09G 3/3648 345/206

FOREIGN PATENT DOCUMENTS

KR 10-2007-0034381 A 3/2007
KR 10-2015-0121389 A 10/2015
KR 10-2016-0009793 A 1/2016
KR 10-2016-0041133 A 4/2016

* cited by examiner

METHOD OF DRIVING DISPLAY PANEL, DISPLAY PANEL DRIVING APPARATUS FOR PERFORMING THE METHOD AND DISPLAY APPARATUS HAVING THE DISPLAY PANEL DRIVING APPARATUS

CROSS-REFERENCE TO RELATED APPLICATION

Korean Patent Application No. 10-2014-0139112, filed on Oct. 15, 2014, and entitled, "Method of Driving Display Panel, Display Panel Driving Apparatus and Display Apparatus having the Display Panel Driving Apparatus," is incorporated by reference herein in its entirety.

BACKGROUND

1. Field

One or more embodiments herein relate to a method and a driver for driving a display panel and an apparatus which includes a display panel driver.

2. Description of the Related Art

A display apparatus may include a display panel and a display panel driving apparatus. The display panel includes a plurality of gate lines, a plurality of data lines, and a plurality of pixels. The display panel driving apparatus includes a gate driver driving the gate lines, a data driver driving the data lines, and a timing controller to control the gate driver and the data driver. An example of such a display apparatus is a liquid crystal display apparatus.

In an attempt to decrease the driving time of the display panel, the gate lines may be divided into at least two areas and the divided gate lines are driven. In this case, a boundary of frames may form between the areas which degrades display quality.

SUMMARY

In accordance with one embodiment, a method for driving a display panel including driving a first display area of the display panel by outputting a data signal of a first frame to the first display area and driving a gate line of a first gate line group in the first display area; and driving a second display area of the display panel by outputting a data signal of a second frame to the second display area and driving a gate line of a second gate line group in the second display area, wherein the first display area is adjacent to the second display area and wherein the first frame is different from the second frame.

The method may include driving a third display area of the display panel by outputting a data signal of a third frame to the third display area, and driving a gate line of a third gate line group in the third display area, wherein the third display area is adjacent to the second display area and wherein the third frame is different from the first frame and the second frame.

The data signal of the first frame may be a data signal of the first display area of an [N−2]-th (N is a natural number greater than three) frame, the data signal of the second frame may be a data signal of the second display area of an [N−1]-th frame, and the data signal of the third frame may be a data signal of the third display area of an [N]-th frame.

Driving the first display area may include sequentially driving gate lines in the first display area from a gate line closer to the second display area to a gate line farther away from the second display area. Driving the second display area may include sequentially driving gate lines in the second display area from a gate line closer to the third display area to a gate line farther away from the third display area. Driving the third display area may include sequentially driving gate lines in the third display area from a gate line farther away from the second display area to a gate line closer to the second display area. The first display area, the second display area, and the third display area may be simultaneously driven.

The data signal of the first frame may be a data signal of the first display area of an [N]-th (N is a natural number greater than two) frame, and the data signal of the second frame may be a data signal of the second display area of an [N−1]-th frame.

Driving the first display area may include sequentially driving gate lines in the first display area from a gate line farther away from the second display area to a gate line closer to the second display area. Driving the second display area may include sequentially driving gate lines in the second display area from a gate line closer to the first display area to a gate line farther away from the first display area. The first display area and the second display area may be simultaneously driven.

In accordance with another embodiment, a display panel driving apparatus includes a gate driver to drive gate lines of a first gate line group in a first display area of a display panel and drive gate lines of a second gate line group in a second display area adjacent to the first display area in the display panel; and a data driver to output a data signal of a first frame to the first display area and to output a data signal of a second frame to the second display area, wherein the second frame is different from the first frame.

The gate driver may drive gate lines of a third gate line group in a third display area adjacent to the second display area, and the data driver may output a data signal of a third frame to the third display area, wherein the third frame is different from the first frame and the second frame.

The data signal of the first frame may be a data signal of the first display area of an [N−2]-th (N is a natural number greater than three) frame, the data signal of the second frame may be a data signal of the second display area of an [N−1]-th frame, and the data signal of the third frame may be a data signal of the third display area of an [N]-th frame. The data signal of the first frame may be a data signal of the first display area of an [N]-th (N is a natural number greater than two) frame, and the data signal of the second frame may be a data signal of the second display area of an [N−1]-th frame.

In accordance with another embodiment, a display apparatus includes a display panel including a first display area having gate lines of a first gate line group and a second display area having gate lines of a second gate line group; and a driver including a gate driver to drive the gate lines of the first gate line group and the gate lines of the second gate line group, and a data driver to output a data signal of a first frame to the first display area and to output a data signal of a second frame to the second display area, wherein the first display area is adjacent to the second display area and wherein the first frame is different from the second frame.

The display panel may include a third display area having gate lines of a third gate line group, the gate driver is to drive the gate lines of the third gate line group, and the data driver is to output a data signal of a third frame to the third display area, wherein the third display area is adjacent to the second display area and wherein the third frame different from the first frame and the second frame.

The data signal of the first frame may be a data signal of the first display area of an [N−2]-th (N is a natural number greater than three) frame, the data signal of the second frame may be a data signal of the second display area of an [N−1]-th frame, and the data signal of the third frame may be a data signal of the third display area of an [N]-th frame.

The data signal of the first frame may be a data signal of the first display area of an [N]-th (N is a natural number greater than two) frame, and the data signal of the second frame may be a data signal of the second display area of an [N−1]-th frame. The gate driver and the data driver may be adjacent to a same side of the display panel.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
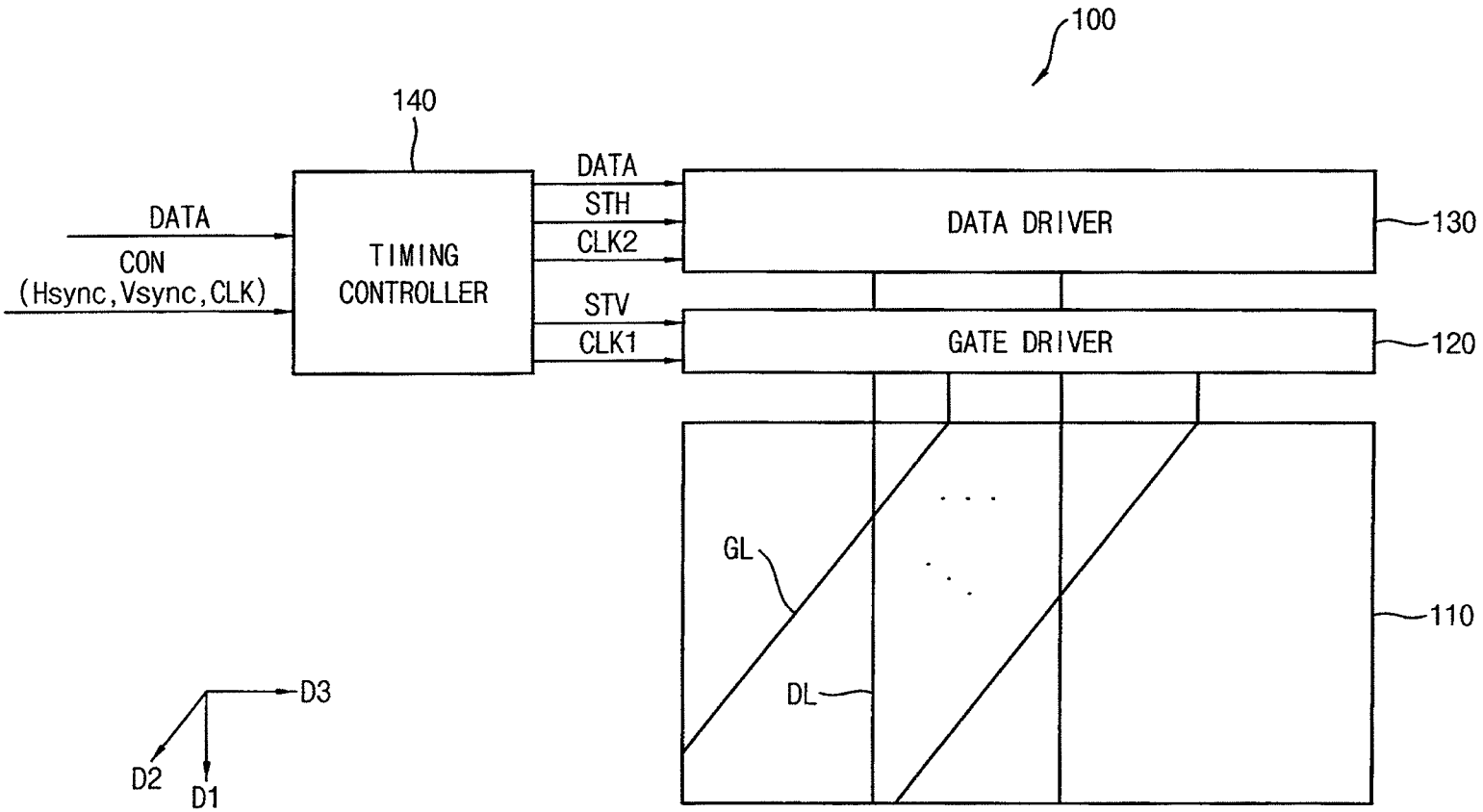
FIG. 1 illustrates an embodiment of a display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display apparatus 100 which includes a display panel 110, a gate driver 120, a data driver 130, and a timing controller 140.

The display panel 110 receives a data signal DS based on image data DATA from the timing controller 140 to display an image. For example, the image data DATA may be two-dimensional plane image data. Alternatively, the image data DATA may include a left-eye image data and a right-eye image data for displaying a three-dimensional stereoscopic image.

The display panel 110 includes gate lines GL and data lines DL for a plurality of pixels. The data lines DL extend in a first direction D1 and are arranged in a third direction D3 substantially perpendicular to the first direction D1. The gate lines GL extends in a second direction D2 slanted with respect to the first direction D1.

The gate driver 120, the data driver 130, and the timing controller 140 may be included in a display panel driving apparatus for driving the display panel 110. The gate driver 120 and data driver 130 may be adjacent to one side of display panel 110.

The gate driver 120 generates a gate signal based on a gate start signal STV and a gate clock signal CLK1 from the timing controller 140, and outputs a gate signal to the gate line GL.

The data driver 130 outputs a data signal to the data line DL based on a data start signal STH and a data clock signal CLK2 from the timing controller 140. The timing controller 140 receives the image data DATA and a control signal CON, for example, from an external source.

In one embodiment, the control signal CON includes a horizontal synchronous signal Hsync, a vertical synchronous signal Vsync, and a clock signal CLK. The timing controller 140 generates the data start signal STH using the horizontal synchronous signal Hsync and outputs the data start signal STH to the data driver 130. In addition, the timing controller 140 generates the gate start signal STV using the vertical synchronous signal Vsync and outputs the gate start signal STV to the gate driver 120. In addition, the timing controller 140 generates the gate clock signal CLK1 and the data clock signal CLK2 using the clock signal CLK, outputs the gate clock signal CLK1 to the gate driver 120, and outputs the data clock signal CLK2 to the data driver 130.

Figure 2:
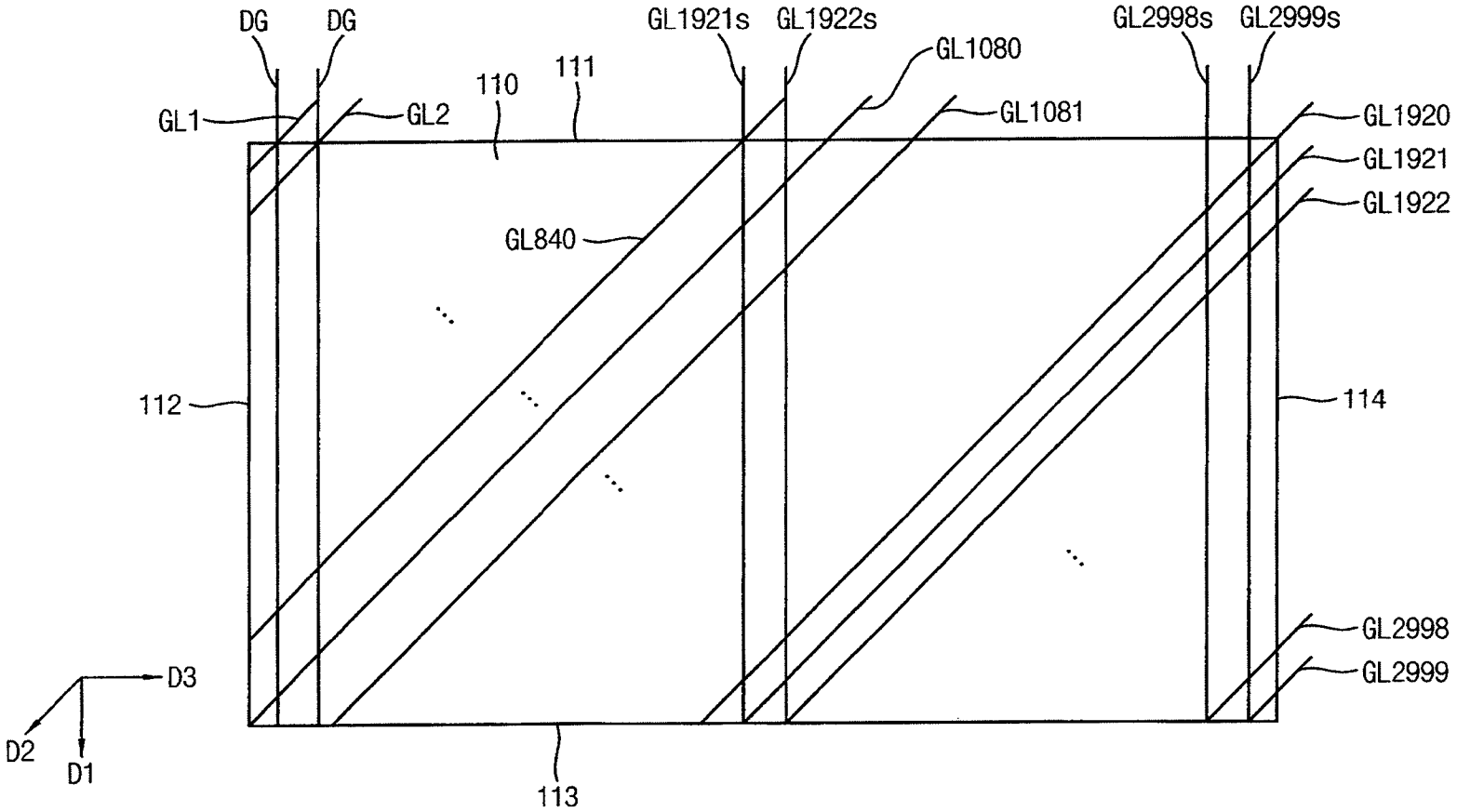
FIG. 2 illustrating an example arrangement of gate lines in a display panel.
Figure 3:
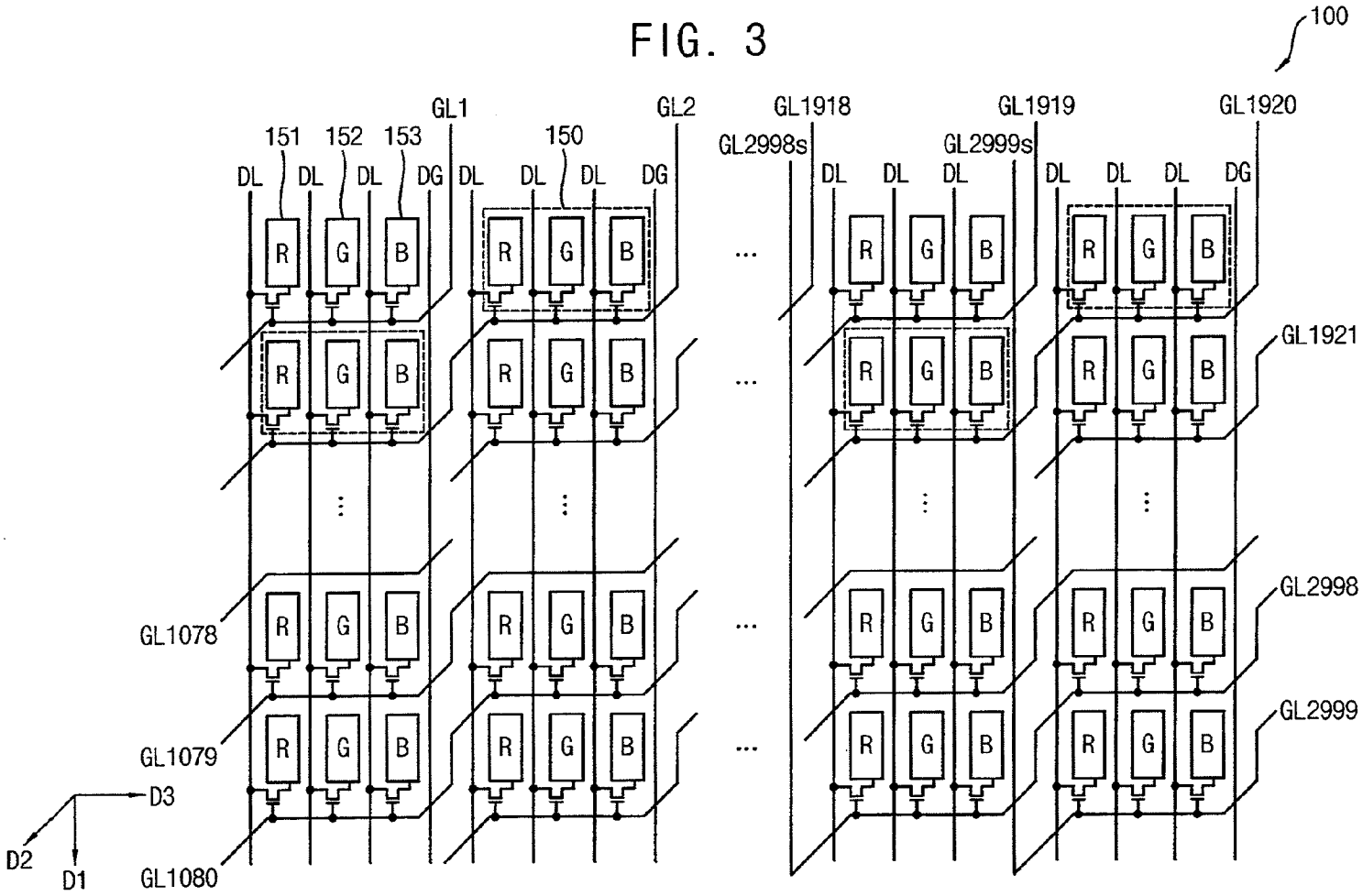
FIG. 3 illustrates another view of the display panel.

FIG. 2 illustrates an example arrangement of the gate lines GL in the display panel 110 of FIG. 1, and FIG. 3 is a plan view of the display panel 110 of FIG. 1. Referring to FIGS. 1 to 3, the display panel 110 includes a first side 111, a second side 112, a third side 113, and a fourth side 114. The first side 111 faces the third side 113. The first side 111 and the third side 113 may correspond to long sides of the display panel 110, which are longer than the second side 112 and the fourth side 114. The second side 112 faces the fourth side 114. The second side 112 and the fourth side 114 may correspond to short sides of the display panel 110, which are shorter than each of the first side 111 and the third side 113.

The display panel 110 also includes a plurality of unit pixels 150. Each unit pixel 150 includes a plurality of sub pixels. For example, each unit pixel 150 may include a first sub pixel 151, a second sub pixel 152, and a third sub pixel 153. The first sub pixel 151, the second sub pixel 152, and the third sub pixel 153 may be a red sub pixel, a green sub pixel, and a blue sub pixel, respectively. Each of the first sub pixel 151, the second sub pixel 152, and the third sub pixel 153 is electrically connected to one of the gate lines GL and corresponding ones of the data lines DL.

The display panel 110 has a predetermined resolution, e.g., a resolution of 1920*1080. In this case, the number of the gate lines GL may be (horizontal resolution+vertical resolution−1). Thus, the gate lines GL may include first to $2999^{th}$ gate lines GL1, GL2, . . . , and GL2999.

The first to $1920^{th}$ gate lines GL1, GL2, . . . , and GL1920 extend from the first side 111 in the second direction D2. For example, the first to $1080^{th}$ gate lines GL1, GL2, . . . , and GL1080 may extend from the first side 111 to the second side 112 in the second direction D2. Thus, each of first terminals of the first to 1080$^{th}$ gate lines GL1, GL2, . . . , and GL1080 may be at the first side 111, and each of second terminals of the first to 1080$^{th}$ gate lines GL1, GL2, . . . , and GL1080 may be at the second side 112.

The 1081$^{st}$ to 1920$^{th}$ gate lines GL1081, . . . , and GL1920 gate lines may extend from the first side 111 to the third side 113 in the second direction D2. Thus, each of first terminals of the 1081$^{st}$ to 1920$^{th}$ gate lines GL1081, . . . , and GL1920 may be at the first side 111, and each of second terminals of the 1081$^{st}$ to 1920$^{th}$ gate lines GL1081, . . . , and GL1920 may be at the third side 113.

The 1921$^{st}$ to 2999$^{th}$ gate lines GL1921, . . . , and GL2999 extend from the fourth side 114 in the second direction D2. For example, the 1921$^{st}$ to 2999$^{th}$ gate lines GL 1921, . . . , and GL2999 may extend from the fourth side 114 to the third side 113 in the second direction D2. Thus, each of first terminals of the 1921$^{st}$ to 2999$^{th}$ gate lines GL1921, . . . , and GL2999 may be at the fourth side 114, and each of second terminals of the 1921$^{st}$ to 2999$^{th}$ gate lines GL1921, . . . , and GL2999 may be at the third side 113.

In addition, the display panel 110 may further includes 1921$^{st}$ to 2999$^{th}$ gate subsidiary gate lines GL1921*s*, GL1922*s*, . . . , and GL2999*s* electrically connected to the 1921$^{st}$ to 2999$^{th}$ gate lines GL1921, . . . , and GL2999, respectively. The 1921$^{st}$ to 2999$^{th}$ gate subsidiary gate lines GL1921*s*, GL1922*s*, . . . , and GL2999*s* extend in the first direction D1 and are disposed in the third direction D3.

The gate driver 120 is adjacent the first side 111 of the display panel 110. The first to 2999$^{th}$ gate lines GL1, GL2, . . . , and GL2999 are electrically connected to the gate driver 120. The first to 1920$^{th}$ gate lines GL1, GL2, . . . , and GL1920 are directly connected to the gate driver 120. The 1921$^{st}$ to 2999$^{th}$ gate lines GL1921, . . . , and GL2999 are electrically connected to the gate driver 120 through the 1291$^{st}$ to 2999$^{th}$ gate subsidiary lines GL1921*s*, GL1921*s*, . . . , and GL2999*s*.

The display panel 110 may further include a plurality of dummy lines DG. The dummy lines DG extend in the first direction D1 and are disposed in the third direction D3. The dummy lines DG may be in an area where the 1291$^{st}$ to 2999$^{th}$ gate subsidiary lines GL1921*s*, GL1921*s*, . . . , and GL2999*s* are not located.

The data driver 130 is disposed adjacent to the first side 111 of the display panel 110, and is electrically connected to the data lines DL.

Figure 4:
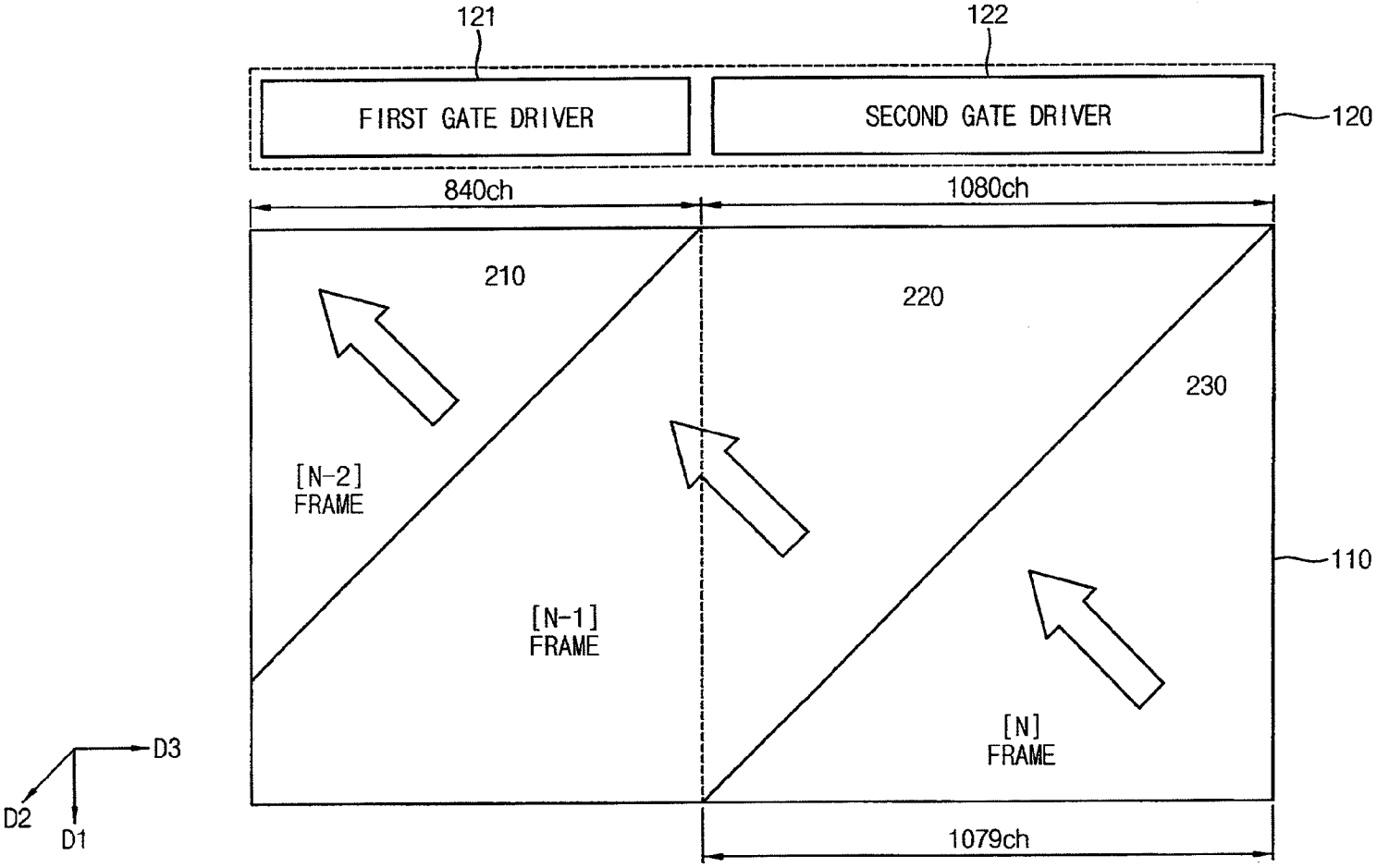
FIG. 4 illustrates an embodiment of the display panel and a gate driver.
Figure 5:
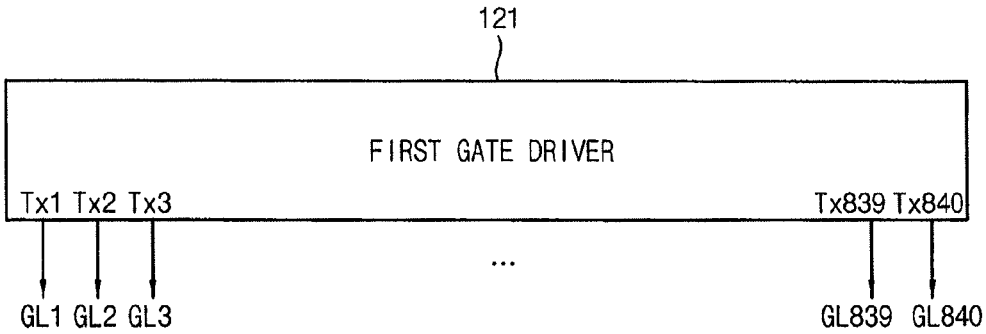
FIG. 5 illustrates an embodiment of a first gate driver in the gate driver.
Figure 6:
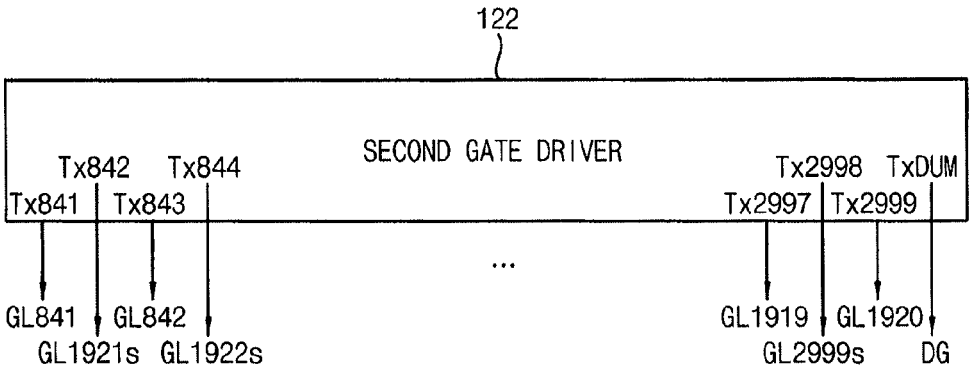
FIG. 6 illustrates an embodiment of a second gate driver in the gate driver.
Figure 7:
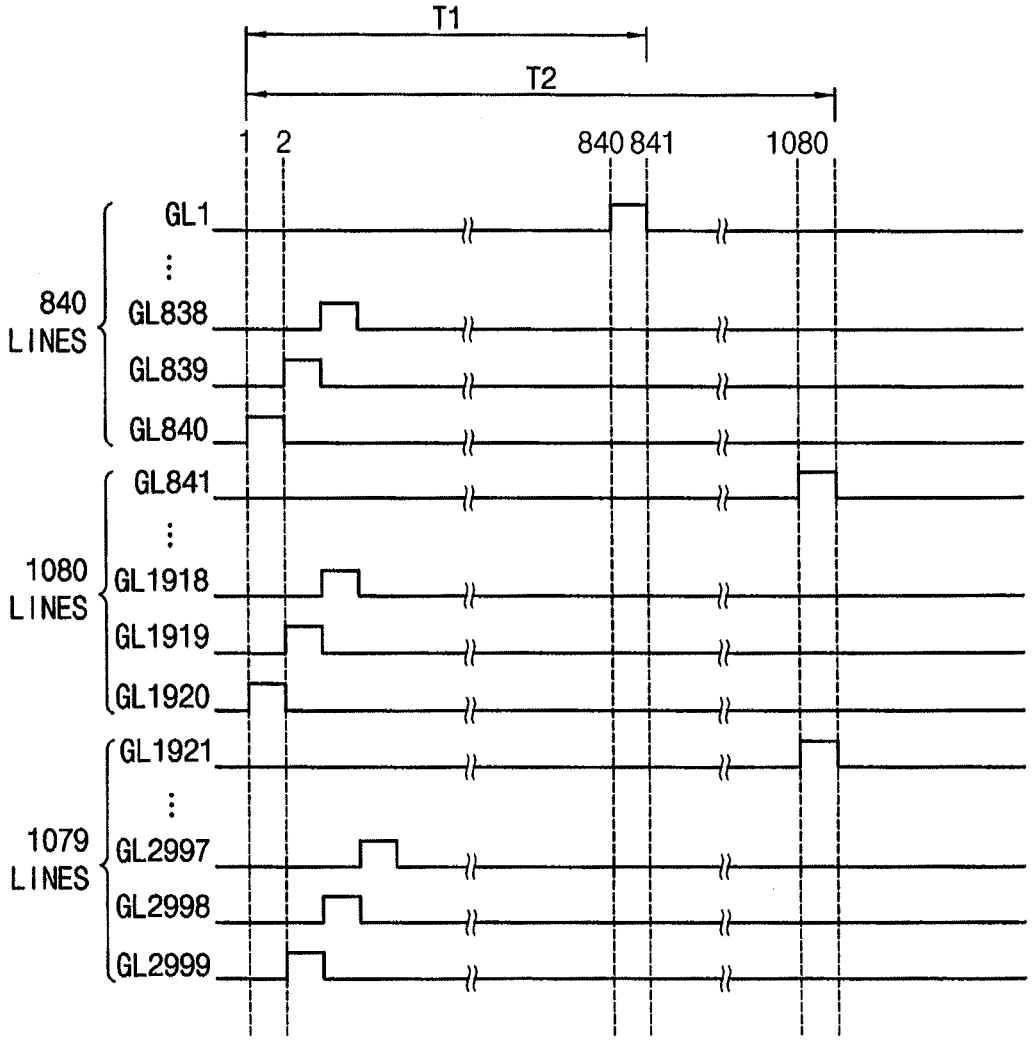
FIG. 7 illustrates an embodiment of gate signals.

FIG. 4 illustrates an embodiment including the display panel 110 and the gate driver 120 of FIG. 1. FIG. 5 illustrates an embodiment including a first gate driver 121 in the gate driver 120 of FIG. 4. FIG. 6 illustrates an embodiment including a second gate driver 122 in the gate driving area 120 of FIG. 4. FIG. 7 illustrates an embodiment of gate signals applied to the first to 2999$^{th}$ gate lines GL1, . . . , and GL2999 of FIG. 2.

Referring to FIGS. 1 to 7, the display panel 110 may include a first display area 210, a second display area 220, and a third display area 230. The second display area 220 may be adjacent to the first display area 210. The third display area 230 may be adjacent to the second display area 220. The gate lines GL may include a first gate line group, a second gate line group, and a third gate line group. The first gate line group is in the first display area 210. In addition, the first gate line group may include the first to 840$^{th}$ gate lines GL1, . . . , and GL840. The second gate line group is in the second display area 220. In addition, the second gate line group may include the 841$^{st}$ to 1920$^{th}$ gate lines GL841, . . . , and GL1920. The third gate line group is in the third display area 230. In addition, the third gate line group may include the 1921$^{st}$ to 2999$^{th}$ gate lines GL1921, . . . , and GL2999.

The gate driver 120 simultaneously drives the first display area 210, the second display area 220, and the third display area 230. For example, the first gate driver 121 may drive the first to 840$^{th}$ gate lines GL1, . . . , and GL840 included in the first display area 210, and the second gate driver 122 may drive the 841$^{st}$ to 1920$^{th}$ gate lines GL841, . . . , and GL1920 included in the second display area 220 and the 1921$^{st}$ to 2999$^{th}$ gate lines GL1921, . . . , and GL2999 included in the third display area 230.

The first gate driver 121 is connected to the first to 840$^{th}$ gate lines GL1, . . . , and GL840 included in the first area 210. For example, the first gate driver 121 may include first to 840$^{th}$ output terminals Tx1, Tx2, . . . , and Tx840 electrically connected to the first to 840 gate lines GL1, . . . , and GL840, respectively.

The first gate driver 121 may sequentially output the gate signals in a backward direction through the first to 840$^{th}$ output terminals Tx1, Tx2, . . . , and Tx840 during a first period T1. For example, the first gate driver 121 may sequentially drive the 840$^{th}$ to first gate lines GL840, GL839, . . . , and GL1. When the first gate driver 121 of the gate driver 120 sequentially drives the 840$^{th}$ to first gate lines GL840, GL839, . . . , and GL1 in the first display area 210, the data driver 130 outputs a data signal of a first frame to the data line in the first display area 210. The data signal of the first frame may be a data signal of the first display area 210 of an [N−2]-th frame.

The second gate driver 122 is connected to the 841$^{st}$ to 1920$^{th}$ gate lines GL841, . . . , and GL1920 in the second display area 220. In addition, the second gate driver 122 is connected to the 1921$^{st}$ to 2999$^{th}$ gate lines GL1921, . . . , and GL2999 in the third display area 230. For example, the second gate driver 122 may include 841$^{st}$ to 2999$^{th}$ output terminals Tx841, Tx842, . . . , and Tx2999 electrically connected to the 841$^{st}$ to 2999$^{th}$ gate lines GL841, . . . , and GL2999.

Odd-numbered output terminals Tx841, Tx843, . . . , and Tx2999 of the 841$^{st}$ to 2999$^{th}$ output terminals Tx841, Tx842, . . . , and Tx2999 may be electrically connected to the 841$^{st}$ to 1920$^{th}$ gate lines GL841, . . . , and GL1920, respectively.

Even-numbered output terminals Tx842, Tx844, . . . , and Tx2998 of the 841$^{st}$ to 2999$^{th}$ output terminals Tx841, Tx842, . . . , and Tx2999 may be electrically connected to the 1921$^{st}$ to 2999$^{th}$ gate lines GL1921, . . . , and GL2999, respectively.

The even-numbered output terminals Tx842, Tx844, . . . , and Tx2998 of the 841$^{st}$ to 2999$^{th}$ output terminals Tx841, Tx842, . . . , and Tx2999 of the second gate driver 122 may be electrically connected to the 1921$^{st}$ to 2999$^{th}$ gate lines GL1921, . . . , and GL2999 through the 1291$^{st}$ to 2999$^{th}$ gate subsidiary lines GL1921*s*, GL1922*s*, . . . , and GL2999*s*.

The second gate driver 122 may sequentially output the gate signals in a backward direction through the odd-numbered output terminals Tx841, Tx843, . . . , and Tx2999 of the 841$^{st}$ to 2999$^{th}$ output terminals Tx841, Tx842, . . . , and Tx2999 during a second period T2. For example, the second gate driver 122 may sequentially drive the 1920$^{th}$ to 841$^{st}$ gate lines GL1920, GL1919, . . . , and GL841. When the second gate driver 122 of the gate driver 120 sequentially drives the 1920$^{th}$ to 841$^{st}$ gate lines GL1920, GL1919, . . . , and GL841 in the second display area 220, the data driver 130 outputs a data signal of a second frame to the data line in the second display area 220. The data signal of the second frame may be a data signal of the second display area 220 of an [N−1]-th frame.

Thus, when the [N−1]-th frame next to the [N−2]-th frame is displayed in the first display area 210 adjacent to the second display area 220, the appearance of a boundary between frames in an area adjacent to a boundary between the first display area 210 and the second display area 220 may be reduced or prevented.

The second gate driver 122 may sequentially output the gate signals in a backward direction through the even-numbered output terminals Tx842, Tx844, . . . , and Tx2998 of the $841^{st}$ to $2999^{th}$ output terminals Tx841, Tx842, . . . , and Tx2999 during a second period T2. For example, the second gate driver 122 may sequentially drive the $2999^{th}$ to 1920 gate lines GL2999, GL2998, . . . , and GL1921. When the second gate driver 122 outputs the gate signal through the $2997^{th}$ output terminal, after outputting the gate signal through the $2999^{th}$ output terminal Tx2999, the second gate driver 122 may output the gate signal through the $2998^{th}$ output terminal Tx2998. Thus, the $2999^{th}$ to $1921^{st}$ gate lines GL2999, GL2998, . . . , and GL1921 in the third display area 230 may be driven later by one line, compared to the $1920^{th}$ to $841^{st}$ gate lines GL1920, GL1919, . . . , and GL841 in the second area 220.

When the second gate driver 122 of the gate driver 120 sequentially drive the $2999^{th}$ to $1921^{st}$ gate lines GL2999, GL2998, . . . , and GL1921 in the third display area 230, the data driver 130 outputs a data signal of a third frame to the data line in the third display area 230. The data signal of the third frame may be a data signal of the third display area 230 of an [N]-th frame.

Thus, when the [N]-th frame next to the [N−1]-th frame is displayed in the second display area 220 adjacent to the third display area 220, the appearance of a boundary between frames in an area adjacent to a boundary between the second display area 220 and the third display area 230 may be reduced or prevented.

Figure 8:
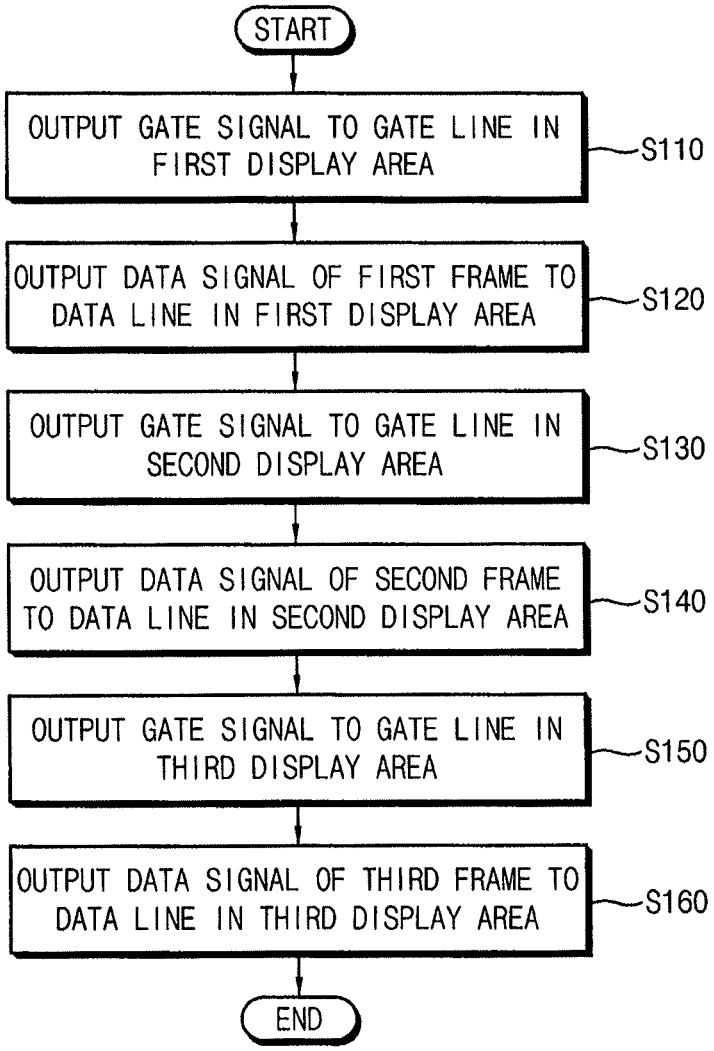
FIG. 8 illustrates an embodiment of a method for driving a display panel.

FIG. 8 illustrates an embodiment of a method for driving a display panel, which, for example, may be performed by the driving apparatus of FIG. 1. Referring to FIGS. 1 to 8, the method includes outputting the gate signal to the gate line GL in the first display area 210 (operation S110). For example, the first gate driver 121 of the gate driver 120 sequentially outputs the gate signals in the backward direction through the first to $840^{th}$ output terminals Tx1, Tx2, . . . , and Tx840 during the first period T1 to sequentially drive the $840^{th}$ to first gate lines GL840, GL839, . . . , and GL1.

The data signal of the first frame is output to the data line in the first display area 210 (operation S120). For example, when the first gate driver 121 of the gate driver 120 sequentially drives the $840^{th}$ to first gate lines GL840, GL839, . . . , and GL1 in the first display area 210, the data driver 130 outputs the data signal of the first frame to the data line DL in the first display area 210. The data signal of the first frame is the data signal of the first display area 210 of the [N−2]-th frame.

The gate signal is output to the gate line GL in the second display area 220 (operation S130). For example, the second gate driver 122 of the gate driver 120 sequentially outputs the gate signals in the backward direction through the odd-numbered output terminals Tx841, Tx843, . . . , and Tx2999 of the $841^{st}$ to $2999^{th}$ output terminals Tx841, Tx842, . . . , and Tx2999 during the second period T2 to sequentially drive the $1920^{th}$ to $841^{st}$ gate lines GL1920, GL1919, . . . , and GL841.

The data signal of the second frame is output to the data line DL in the second display area 220 (operation S140). For example, when the second gate driver 122 of the gate driver 120 sequentially drives the $1920^{th}$ to $841^{st}$ gate lines GL1920, GL1919, . . . , and GL841 in the second display area 220, the data driver 130 outputs the data signal of the second frame to the data line in the second display area. The data signal of the second frame is the data signal of the second display area 210 of the [N−1]-th frame.

The gate signal is output to the gate line in the third display area 230 (operation S150). For example, the second gate driver 122 of the gate driver 120 sequentially outputs the gate signals in the backward direction through the even-numbered output terminals Tx842, Tx844, . . . , and Tx2998 of the $841^{st}$ to $2999^{th}$ output terminals Tx841, Tx842, . . . , and Tx2999 during the second period T2 to sequentially drive the $2999^{th}$ to $1921^{st}$ gate lines GL2999, GL2998, . . . , and GL1921.

The data signal of the third frame is output to the data line DL in the third display area 230 (operation S160). For example, when the second gate driver 122 of the gate driver 120 sequentially drives the $2999^{th}$ to $1921^{st}$ gate lines GL2999, GL2998, . . . , and GL1921 in the third display area 230, the data driver 130 outputs the data signal of the third frame to the data line in the third display area 230. The data signal of the third frame is the data signal of the third display area 230 of the [N]-th frame.

In accordance with the present embodiment, the display panel driving apparatus including the gate driver 120 and the data driver 130 simultaneously drives the first display area 210, the second display area 220, and the third display area 230. As a result, the driving time of the display panel 110 may be reduced.

In addition, the appearance of a boundary between the frames in the area adjacent to the boundary between the first display area 210 and the second display area 220 may be reduced or prevented. Also, the appearance of a boundary between the frames in the area adjacent to the boundary between the second display area 220 and the third display area 230 may be reduced or prevented. Thus, display quality of the display apparatus 100 may be improved.

Figure 9:
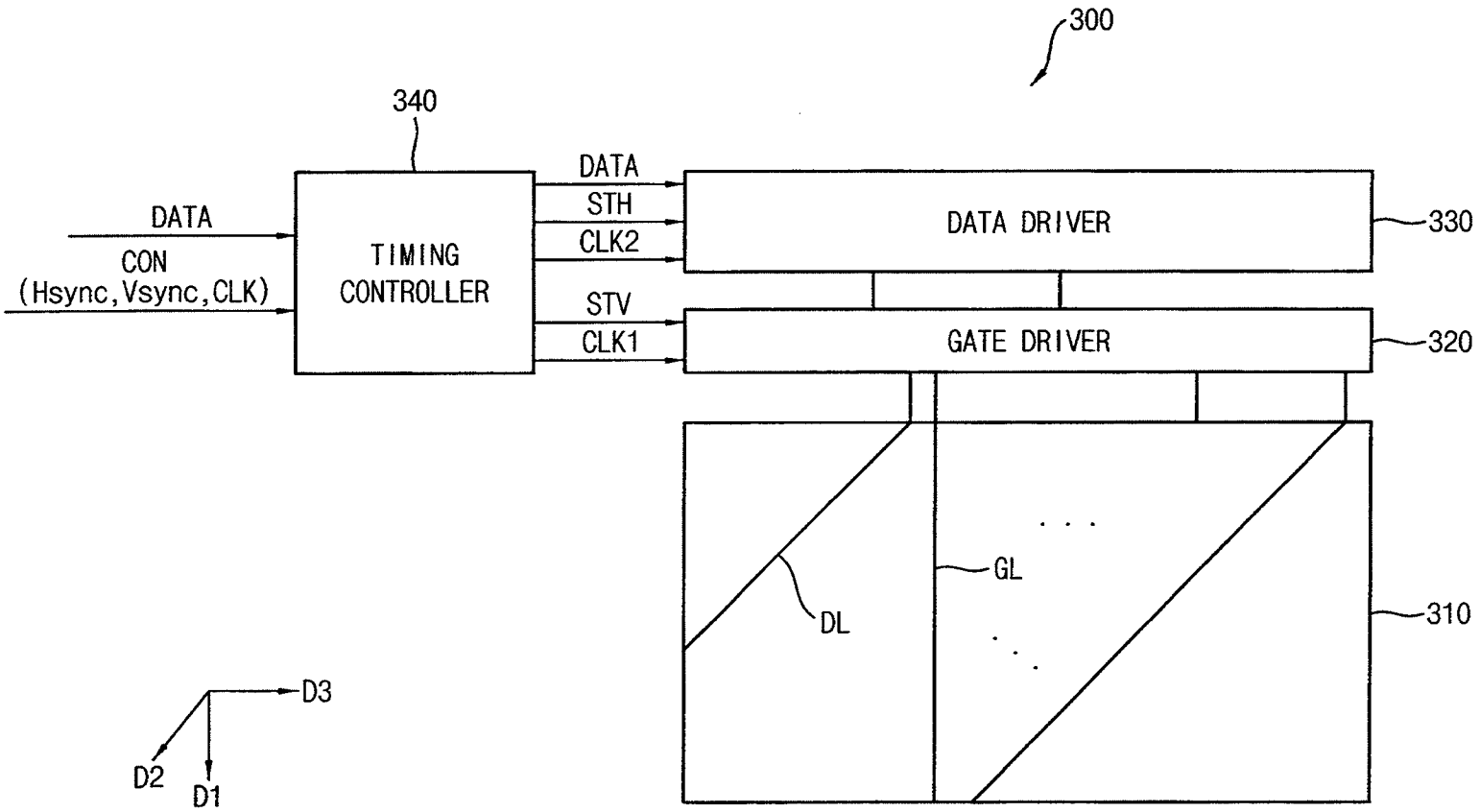
FIG. 9 illustrates an embodiment of a display apparatus.

FIG. 9 illustrates another embodiment of a display apparatus 300 which includes a display panel 310, a gate driver 320, a data driver 330, and a timing controller 340.

The display panel 310 receives a data signal DS based on image data DATA from the timing controller 340 to display an image. For example, the image data DATA may be two-dimensional plane image data. Alternatively, the image data DATA may include a left-eye image data and a right-eye image data for displaying a three-dimensional stereoscopic image.

The display panel 310 includes gate lines GL and data lines DL for a plurality of pixels. The gate lines GL extend in a first direction D1 and are arranged in a third direction D3 substantially perpendicular to the first direction D1. The data line DL extends in a second direction D2 slanted with respect to the first direction D1.

The gate driver 320, the data driver 330, and the timing controller 340 may be included in a driving apparatus for driving the display panel 310. The gate driver 320 and the data driver 330 may be adjacent to one side of the display panel 310.

The gate driver 320 generates a gate signal based on a gate start signal STV and a gate clock signal CLK1 from the timing controller 340, and outputs the gate signal to the gate line GL.

The data driver 330 outputs a data signal to the data line DL based on a data start signal STH and a data clock signal CLK2 from the timing controller 340.

The timing controller 340 receives the image data DATA and a control signal CON, for example, from an external source. The control signal CON may include a horizontal synchronous signal Hsync, a vertical synchronous signal Vsync, and a clock signal CLK. The timing controller 340 generates the data start signal STH using the horizontal synchronous signal Hsync and outputs the data start signal STH to the data driver 330. In addition, the timing controller 340 generates the gate start signal STV using the vertical synchronous signal Vsync and outputs the gate start signal STV to the gate driver 320. In addition, the timing controller 340 generates the gate clock signal CLK1 and the data clock signal CLK2 using the clock signal CLK, outputs the gate clock signal CLK1 to the gate driver 320, and outputs the data clock signal CLK2 to the data driver 330.

Figure 10:
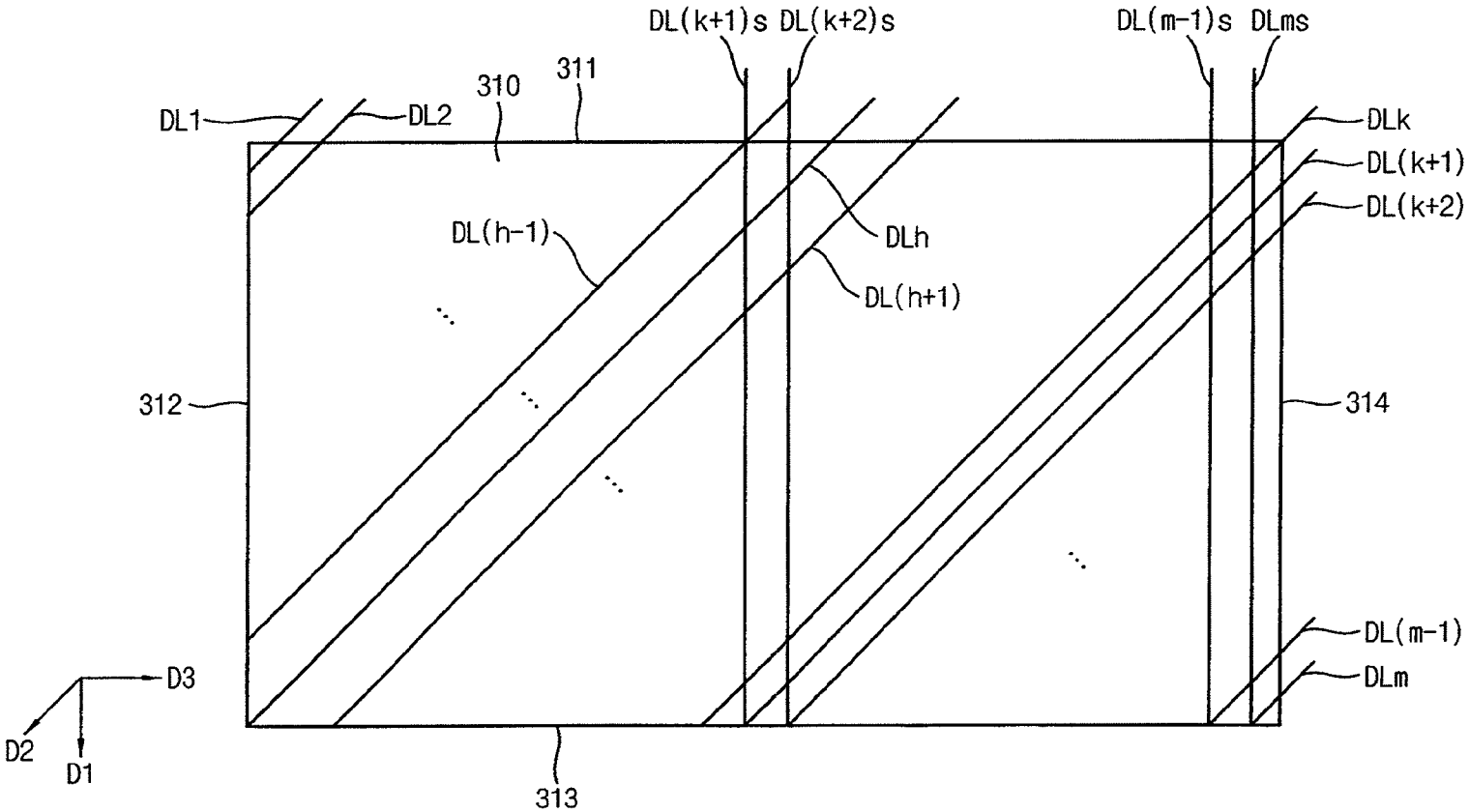
FIG. 10 illustrates an example arrangement of data lines.

FIG. 10 illustrates an example arrangement of the data lines DL in the display panel 310 of FIG. 9. Referring to FIGS. 9 and 10, the display panel 310 includes a first side 311, a second side 312, a third side 313, and a fourth side 314. The first side 311 faces the third side 313. The first side 311 and the third side 313 may correspond to long sides of the display panel 310, which sides are longer than the second side 312 and the fourth side 314. The second side 312 faces the fourth side 314. The second side 312 and the fourth side 314 correspond to short sides of the display panel 310, which sides are shorter than the first side 311 and the third side 313.

The data lines DL may include first to m-th data lines DL1, DL2, . . . , and DLm.

The first to k-th data lines DL1, DL2, . . . , and DLk extend from the first side 311 in the second direction D2. For example, the first to h-th data lines DL1, DL2, . . . , and DLh may extend from the first side 311 to the second side 312 in the second direction D2. Thus, each of first terminals of the first to h-th data lines DL1, DL2, . . . , and DLh may be at the first side 311, and each of second terminals of the first to h-th data lines DL1, DL2, . . . , and DLh may be at the second side 312.

The (h+1)-th to k-th data lines DL(h+1), . . . , and DLk may extend from the first side 311 to the third side 313 in the second direction D2. Thus, each of first terminals of the (h+1)-th to k-th data lines DL(h+1), . . . , and DLk may be at the first side 311, and each of second terminals of the (h+1)-th to k-th data lines DL(h+1), . . . , and DLk may be at the third side 313.

The (k+1)-th to m-th data lines DL(k+1), DL(k+2), . . . , and DLm extend from the fourth side 314 in the second direction D2. For example, the (k+1)-th to m-th data lines DL(k+1), DL(k+2), . . . , and DLm may extend from the fourth side 314 to the third side 313 in the second direction D2. Thus, each of first terminals of the (k+1)-th to m-th data lines DL(k+1), DL(k+2), . . . , and DLm may be at the fourth side 314, and each of second terminals of the (k+1)-th to m-th data lines DL(k+1), DL(k+2), . . . , and DLm may be at the third side 313.

The display panel 310 also includes (k+1)-th to m-th data subsidiary lines DL(k+1)s, DL(k+2)s, . . . , and DLms electrically connected to the (k+1)-th to m-th data lines DL(k+1), DL(k+2), . . . , and DLm, respectively. Each of the (k+1)-th to m-th data subsidiary lines DL(k+1)s, DL(k+2)s, . . . , and DLms extends in the first direction and is arranged in the third direction D3.

The data driver 330 is adjacent to the first side 311 of the display panel 310. The first to m-th data lines DL1, DL2, . . . , and DLm are electrically connected to the data driver 330. The first to k-th data lines DL1, DL2, . . . , and DLk are directly connected to the data driver 330. The (k+1)-th to m-th data lines DL(k+1), DL(k+2), . . . , and DLm are electrically connected to the data driver 330 through the (k+1)-th to m-th data subsidiary lines DL(k+1)s, DL(k+2)s, . . . , and DLms, respectively.

The gate driver 320 is adjacent to the first side 311 of the display panel 310. The gate driver 320 is electrically connected to the gate lines GL.

Figure 11:
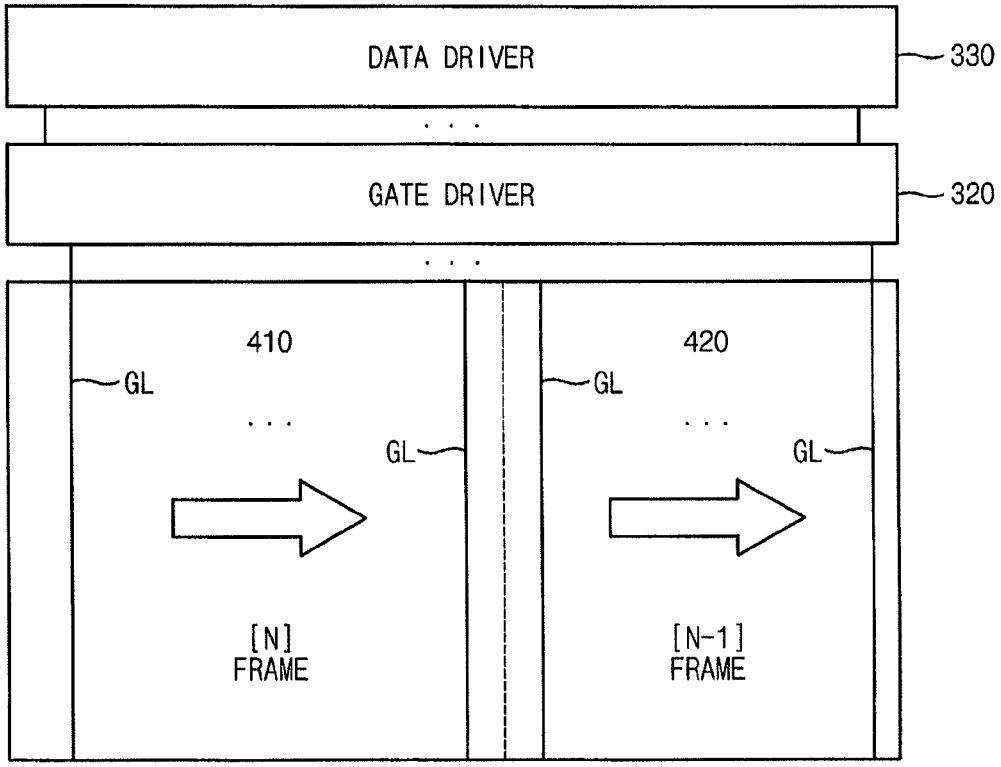
FIG. 11 illustrates an embodiment of a display panel, a gate driver, and a data driver.

FIG. 11 illustrates another embodiment which includes the display panel 310, the gate driver 320, and the data driver 330 of FIG. 9. Referring to FIGS. 9 to 11, the display panel 310 includes a first display area 410 and a second display area 420. The second display area 420 may be adjacent to first display area 410.

The gate lines GL may include a first gate line group and a second gate line group. The first gate line group is in the first display area 410. The second gate line group is in the second display area 420.

The gate driver 320 simultaneously drives the first display area 410 and the second display area 420. For example, the gate driver 320 sequentially drives the gate lines GL of the first gate line group in the first display area 410 in a forward direction and sequentially drives the gate lines GL of the second gate line group in the second display area 420 in a forward direction. Thus, the gate driver 320 sequentially drives the gate lines in the first display area 410 from a gate line GL far from the second display area 420 to a gate line GL close to the second display area 420. In addition, the gate driver 320 sequentially drives the gate lines in the second display area 420 from a gate line GL close to the first display area 410 to a gate line GL far from the first display area 410.

When the gate driver 320 sequentially drives the gate lines of the first gate line group in the first display area 410, the data driver 330 outputs a data signal of a first frame to the data line DL in the first display area 410. The data signal of the first frame may be a data signal of the first display area 410 of an [N]-th frame.

When the gate driver 320 sequentially drives the gate lines of the second gate line group in the second display area 420, the data driver 330 outputs a data signal of a second frame to the data line DL in the second display area 420. The data signal of the second frame may be a data signal of the second display area 420 of an [N−1]-th frame.

Thus, when the [N]-th frame next to the [N−1]-th frame is displayed in the second display area 420 adjacent to the first display area 410, the appearance of a boundary between frames in an area adjacent to a boundary between the first display area 410 and the second display area 420 may be reduced or prevented.

Figure 12:
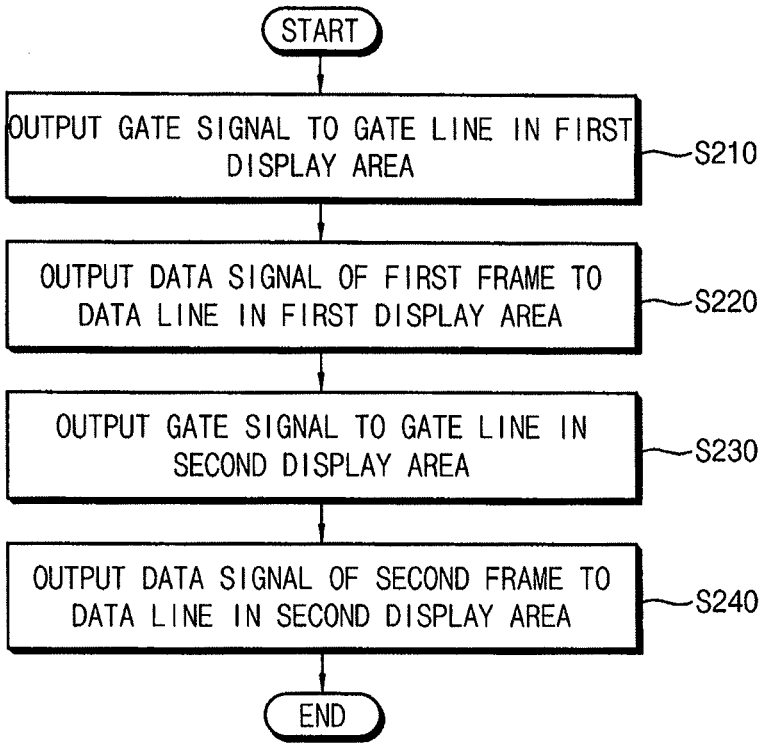
FIG. 12 illustrates another embodiment of a method for driving a display panel.

FIG. 12 illustrates another embodiment of a method for driving a display panel, which, for example, may be performed by the display panel driving apparatus of FIG. 9. Referring to FIGS. 9 to 12, the method includes outputting a gate signal to the gate line in the first display area 410 (operation S210). For example, the gate driver 320 sequentially drives the gate lines of the first gate line group in the first display area 410 in the forward direction.

The data signal of the first frame is output to the data line DL in the first display area 410 (operation S220). For example, when the gate driver 320 sequentially drives the gate lines GL of the first gate line group in the first display area 410 in the forward direction, the data driver 330 outputs the data signal of the first frame to the data line DL in the first display area 410. The data signal of the first frame is the data signal of the first display area 410 of the [N]-th frame.

The gate signal is output to the data line GL in the second display area 420 (operation S230). For example, the gate driver 320 sequentially drives the gate lines GL of the second gate line group in the second display area 420 in the forward direction.

The data signal of the second frame is output to the data line DL in the second display area 420 (operation S240). For example, when the gate driver 320 sequentially drives the gate lines GL of the second gate line group in the second display area 420 in the forward direction, the data driver 330 outputs the data signal of the second frame to the data line DL in the second display area 420. The data signal of the second frame is the data signal of the second display area 420 of the [N−1]-th frame.

In accordance with the present embodiment, the display panel driving apparatus including the gate driver 320 and the data driver 330 simultaneously drives the first display area 410 and the second display area 420. Thus, the driving time of the display panel 310 may be reduced.

In addition, the appearance of a boundary between the frames in the area adjacent to the boundary between the first display area 410 and the second display area 420 may be reduced or prevented. Thus, display quality of the display apparatus 300 may be improved.

By way of summary and review, in an attempt to decrease the driving time of the display panel, the gate lines may be divided into at least two areas and the divided gate lines are driven. However, in this case, a boundary of frames may appear between the areas which degrades display quality.

In accordance with the aforementioned embodiments, a display panel is divided into a first display area and a second display area, and the first display area and the second display area of the display panel are simultaneously driven. Thus, the driving time of the display panel may be decreased. In addition, the appearance of a boundary between frames in an area adjacent to a boundary between a first display area and a second display area may be reduced or prevented. Thus, display quality of a display apparatus may be improved.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A method for driving a display panel, the method comprising:

driving a first display area of the display panel by outputting a data signal of a first frame only to the first display area and driving a gate line of a first gate line group in the first display area; and driving a second display area of the display panel based on a data signal of a second frame and simultaneously with driving of the first display area based on the data signal of the first frame, driving the second display area including outputting a data signal of the second frame to only the second display area and driving a gate line of a second gate line group in the second display area, wherein the first display area is adjacent to the second display area and wherein the first frame is different from the second frame.

2. The method as claimed in claim 1, further comprising:

driving a third display area of the display panel by outputting a data signal of a third frame to the third display area, and driving a gate line of a third gate line group in the third display area, wherein the third display area is adjacent to the second display area and wherein the third frame is different from the first frame and the second frame.

3. The method as claimed in claim 2, wherein:

the data signal of the first frame is a data signal of the first display area of an [N−2]-th (N is a natural number equal to or greater than three) frame, the data signal of the second frame is a data signal of the second display area of an [N−1]-th frame (N is a natural number equal to or greater than three), and the data signal of the third frame is a data signal of the third display area of an [N]-th frame (N is a natural number equal to or greater than three).

4. The method as claimed in claim 3, wherein driving the first display area includes sequentially driving gate lines in the first display area from a gate line closer to the second display area to a gate line farther away from the second display area.

5. The method as claimed in claim 4, wherein driving the second display area includes sequentially driving gate lines in the second display area from a gate line closer to the third display area to a gate line farther away from the third display area.

6. The method as claimed in claim 5, wherein driving the third display area includes sequentially driving gate lines in the third display area from a gate line farther away from the second display area to a gate line closer to the second display area.

7. The method as claimed in claim 2, wherein the first display area, the second display area, and the third display area are simultaneously driven.

8. The method as claimed in claim 1, wherein:

the data signal of the first frame is a data signal of the first display area of an [N]-th (N is a natural number equal to or greater than two) frame, and the data signal of the second frame is a data signal of the second display area of an [N−1]-th frame (N is a natural number equal to or greater than two).

9. The method as claimed in claim 8, wherein driving the first display area includes sequentially driving gate lines in the first display area from a gate line farther away from the second display area to a gate line closer to the second display area.

10. The method as claimed in claim 9, wherein driving the second display area includes sequentially driving gate lines in the second display area from a gate line closer to the first display area to a gate line farther away from the first display area.

11. The method as claimed in claim 1, wherein the first display area and the second display area are simultaneously driven.

12. A display panel driving apparatus, comprising:

a gate driver to drive gate lines of a first gate line group in a first display area of a display panel and drive gate lines of a second gate line group in a second display area adjacent to the first display area in the display panel; and a data driver to output a data signal of a first frame to only the first display area and to output a data signal of a second frame to only the second display area simultaneously with output of the data signal of the first frame to the first display area, wherein the second frame is different from the first frame.

13. The display panel driving apparatus as claimed in claim 12, wherein:

the gate driver is to drive gate lines of a third gate line group in a third display area adjacent to the second display area, and the data driver is to output a data signal of a third frame to the third display area, wherein the third frame is different from the first frame and the second frame.

14. The display panel driving apparatus as claimed in claim 13, wherein:

the data signal of the first frame is a data signal of the first display area of an [N−2]-th (N is a natural number equal to or greater than three) frame, the data signal of the second frame is a data signal of the second display area of an [N−1]-th frame (N is a natural number equal to or greater than three), and the data signal of the third frame is a data signal of the third display area of an [N]-th frame (N is a natural number equal to or greater than three).

15. The display panel driving apparatus as claimed in claim 12, wherein:

the data signal of the first frame is a data signal of the first display area of an [N]-th (N is a natural number equal to or greater than two) frame, and the data signal of the second frame is a data signal of the second display area of an [N−1]-th frame (N is a natural number equal to or greater than two).

16. A display apparatus, comprising:

a display panel including a first display area having gate lines of a first gate line group and a second display area having gate lines of a second gate line group; and a driver including a gate driver to drive the gate lines of the first gate line group and the gate lines of the second gate line group, and a data driver to output a data signal of a first frame to only the first display area and to output a data signal of a second frame to only the second display area simultaneously with output of the data signal of the first frame to the first display area, wherein the first display area is adjacent to the second display area and wherein the first frame is different from the second frame.

17. The display apparatus as claimed in claim 16, wherein:

the display panel includes a third display area having gate lines of a third gate line group, the gate driver is to drive the gate lines of the third gate line group, and the data driver is to output a data signal of a third frame to the third display area, wherein the third display area is adjacent to the second display area and wherein the third frame different from the first frame and the second frame.

18. The display apparatus as claimed in claim 17, wherein:

the data signal of the first frame is a data signal of the first display area of an [N−2]-th (N is a natural number equal to or greater than three) frame, the data signal of the second frame is a data signal of the second display area of an [N−1]-th frame (N is a natural number equal to or greater than three), and the data signal of the third frame is a data signal of the third display area of an [N]-th frame (N is a natural number equal to or greater than three).

19. The display apparatus as claimed in claim 16, wherein:

the data signal of the first frame is a data signal of the first display area of an [N]-th (N is a natural number equal to or greater than two) frame, and the data signal of the second frame is a data signal of the second display area of an [N−1]-th frame (N is a natural number equal to or greater than two).

20. The display apparatus as claimed in claim 16, wherein the gate driver and the data driver are adjacent to a same side of the display panel.

* * * * *